US006440627B2

(12) United States Patent
Shoji et al.

(10) Patent No.: US 6,440,627 B2
(45) Date of Patent: Aug. 27, 2002

(54) TONER FOR DEVELOPING ELECTROSTATIC IMAGE, PROCESS FOR PREPARATION OF THE SAME, DEVELOPER FOR ELECTROSTATIC IMAGE, AND PROCESS FOR FORMING IMAGE

(75) Inventors: Takeshi Shoji; Shuji Sato; Takao Ishiyama; Manabu Serizawa; Masaaki Suwabe; Yasuo Matsumura, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/776,905

(22) Filed: Feb. 6, 2001

(30) Foreign Application Priority Data

Feb. 21, 2000 (JP) ..... 2000-042329

(51) Int. Cl.[7] ..... G03G 9/09

(52) U.S. Cl. ..... 430/108.1; 430/110.3; 430/126; 430/137.14

(58) Field of Search ..... 430/108.23, 108.1, 430/110.1, 110.3, 110.4, 12.6, 137.14

(56) References Cited

U.S. PATENT DOCUMENTS 5,250,996 A * 10/1993 Sugizaki et al. ..... 430/108.24
5,314,773 A * 5/1994 Kubo et al. ..... 430/107.1
5,910,389 A 6/1999 Matsumura et al. ..... 430/111

FOREIGN PATENT DOCUMENTS

| | | |
|---|---|---|
| JP | 63-282749 | 11/1988 |
| JP | 6-250439 | 9/1994 |
| JP | 8-59715 | 3/1996 |
| JP | 10-301333 | 4/1997 |
| JP | 10-239904 | 9/1998 |
| JP | 11-65163 | 3/1999 |

* cited by examiner

*Primary Examiner*—John Goodrow
(74) *Attorney, Agent, or Firm*—Oliff & Berridge, PLC

(57) ABSTRACT

A toner for developing an electrostatic image excellent in fixing property and particularly in light transmissibility and coloring property and satisfying high image quality and high reliability, and a process for producing the same, as well as a developer for an electrostatic image and a process for forming an image are provided. The toner for developing an electrostatic image contains at least a resin component and colorant particles, and the colorant particles exhibit a dispersion state inside the toner observed by a transmission electron microscope. The dispersion state satisfies two conditions, where (1) the colorant particles have a dispersion average particle diameter of 100 nm or less, and (2) the colorant particles have a content of coarse particles of a diameter of 400 nm or more 5% by number or less of the total of the colorant particles.

16 Claims, No Drawings

TONER FOR DEVELOPING ELECTROSTATIC IMAGE, PROCESS FOR PREPARATION OF THE SAME, DEVELOPER FOR ELECTROSTATIC IMAGE, AND PROCESS FOR FORMING IMAGE

FIELD OF THE INVENTION

The present invention relates to a toner for developing an electrostatic image used upon developing an electrostatic image formed by an electrophotographic process or an electrostatic recording process with a developer, and a process for preparation of the toner, as well as a developer for an electrostatic image and a process for forming an image using the toner.

BACKGROUND OF THE INVENTION

A method for visualizing image information through an electrostatic image, such as an electrophotographic process and an electrostatic recording process, is being applied to various fields of art. In the electrophotographic process, an electrostatic image is formed on a photoreceptor by charging and exposing steps and then developed with a developer containing a toner, followed by being visualized through transferring and fixing steps.

The developer used herein includes a two-component developer formed with a toner and a carrier, and a one-component developer using a magnetic toner or a non-magnetic toner solely. As a production process of a toner used in these developers, a kneading and pulverization method has been mainly employed, in which a thermoplastic resin is melted and kneaded with a pigment, a charge controlling agent and a releasing agent, such as a wax, and after cooling, the mixture is finely pulverized. To particles of a toner produced by the kneading and pulverization method, inorganic fine particles or organic fine particles are added depending on necessity to the surface of the particles of the toner for improving the fluidity and the cleaning property.

In recent years, a production process of a toner by a wet production process is also proposed. For example, JP-A-63-282749 and JP-A-6-250439 propose an emulsion polymerization aggregation method, in which a dispersion of resin particles is prepared by emulsion polymerization, and a dispersion of a colorant is prepared by dispersing in an aqueous medium (solvent), both of which are mixed to form aggregated particles corresponding to a toner particle diameter, followed by fusing by heating to produce a toner.

A demand of high image quality is being increased in recent years owing to widespreading of color images. In a digital full color duplicator or printer, a color original image is subjected to color separation by filters of B (blue), R (red) and G (green), and latent images formed with dots of a diameter of from 20 to 70 $\mu$m corresponding to the original image are developed with developers of Y (yellow), M (magenta), C (cyan) and BK (black) by utilizing a subtractive color mixing function. Therefore, colorants contained in the developers greatly influence the image quality. Important factors of the colorants (Y, M and C) added to the toners include good transparency and high coloring power. It has been conventionally difficult to satisfy the factors particularly in a yellow pigment, and various investigations have been made.

In a yellow toner containing a yellow pigment, it is important to have good transparency that the crystalline diameter of the yellow pigment itself is small, and the average particle diameter of the colorant in the toner is small. In the case where the average particle diameter of the colorant is large or the colorant contains a large amount of coarse particles due to aggregation of the yellow pigment itself or aggregation caused in the toner, the OHP transparency is deteriorated owing to deterioration in light transmissibility of the toner. It brings about other problems, such as isolation of the colorant from the toner resin, and deterioration in charging property due to exposure of the colorant on the surface of the toner. In some kinds of yellow pigments, when the average particle diameter of the colorant is too small, it sometimes causes a problem in that the resulting toner has insufficient coloring property.

SUMMARY OF THE INVENTION

Therefore, the invention has been made to solve the problems associated with conventional toner to provide a toner for developing an electrostatic image, a process for producing the same, a developer for an electrostatic image and a process for forming an image.

The invention provides:

1. a toner for developing an electrostatic image excellent in fixing property and particularly in light transmissibility and coloring property to satisfy high image quality and high reliability, and a developer for an electrostatic image using the toner for developing an electrostatic image;

2. a process for producing a toner for developing an electrostatic image that can produce the toner for developing an electrostatic image having the excellent characteristics in a convenient and simple manner without isolation of a colorant and a releasing agent; and 3. a process for forming an image that can form a full color image of high color saturation on paper and an OHP sheet in a convenient manner.

According to an aspect of the invention, the toner for developing an electrostatic image contains at least a resin component and colorant particles, and the colorant particles exhibit a dispersion state inside the toner observed by a transmission electron microscope satisfying two conditions, where (1) the colorant particles have a dispersion average particle diameter of 100 nm or less, and (2) a content of coarse colorant particles of a diameter of 400 nm or more is 5% by number or less based on the total of the colorant particles.

According to another aspect of the invention, the process for preparing the toner for developing an electrostatic image includes an aggregation step of mixing at least one kind of resin particle dispersion, at least one kind of colorant dispersion, at least one kind of releasing agent dispersion, and an aggregating agent to form aggregated particles, and a fusing step of fusing the aggregated particles by heating to a temperature higher than a glass transition point of the resin particles to form toner particles.

The colorant dispersion used in the aggregation step preferably has a 50% particle diameter (volume basis) of colorant particles of 100 nm or less, and also preferably has a 84% particle diameter (volume basis) of colorant particles of 200 nm or less.

In the case of the one-component developer, the toner for developing an electrostatic image of the invention constitutes a developer for an electrostatic image only with the toner for developing an electrostatic image, and in the case of the two-component developer containing a carrier and a toner, the toner for developing an electrostatic image of the invention is used as the toner to constitute the developer for an electrostatic image.

According to still another aspect of the invention, the process for forming an image includes a latent image forming step of forming a latent image on a surface of an electrostatic latent image holding member, a developing step of developing the electrostatic latent image on the surface of the electrostatic latent image holding member by using a layer of a developer for an electrostatic image formed on a surface of a developer holding member to form a toner image, and a transferring step of transferring the toner image on the surface of the electrostatic latent image holding member to a surface of a transfer material. The developer for an electrostatic image contains the toner for developing an electrostatic image according to the invention.

DETAILED DESCRIPTION OF THE INVENTION

The invention will be described in detail below.

Toner for Developing Electrostatic Image (a) Dispersion State of Colorant Particles In the toner for developing an electrostatic image according to the invention, the dispersion state of the colorant particles inside the toner measured by a transmission electron microscope (TEM) necessarily satisfies the following conditions (1) and (2).

(1) The colorant particles have a dispersion average particle diameter of 100 nm or less.

The colorant particles necessarily have a dispersion average particle diameter of 100 nm or less, and preferably from 70 to 90 nm. When the dispersion average particle diameter of the colorant particles exceeds 100 nm, the transparency of the toner for developing an electrostatic image is deteriorated, and free particles are generated, which bring about deterioration in performance and reliability. The particle size distribution of the toner itself is also liable to be broadened. When the dispersion average particle diameter of the colorant particles is 100 nm or less, the toner for developing an electrostatic image can have high transparency and high performance and reliability.

(2) The content of coarse colorant particles of a diameter of 400 nm or more is 5% by number or less based on the total of the colorant particles.

The content of coarse colorant particles of a diameter of 400 nm or more is necessarily 5% by number or less, and preferably 4% by number or less, based on the total of the colorant particles. When the content of the coarse particles exceeds 5% by number, it causes problems, such as reduction in transparency and reduction in charging characteristics under high humidity conditions. When the content of the coarse particles is 5% by number or less, stable image characteristics can be maintained for a long period of time without the problems.

The two conditions (1) and (2) of the dispersion state of the colorant particles are measured by a transmission electron microscope (TEM), and specifically, it is obtained by subjecting a cross sectional image of the toner obtained by a transmission electron microscope to an image analyzing apparatus. In the invention, one thousand particles, for example, are arbitrarily sampled from the toner to be measured, and the dispersion average particle diameter and the content of coarse particles of 400 nm or more are measured for the toner particles.

(b) Colorant Particles

The colorant constituting the colorant particles in the invention is preferably a yellow pigment, which is not particularly limited, and is more preferably a condensed azo series yellow pigment from the standpoint or good reproducibility of neutral colors and high safety. Specific examples thereof include C.I. Pigment Yellow 74, C.I. Pigment Yellow 93, C.I. Pigment Yellow 94, C.I. Pigment Yellow 95, C.I. Pigment Yellow 12, C.I. Pigment Yellow 13, C.I. Pigment Yellow 14, C.I. Pigment Yellow 16, C.I. Pigment Yellow 17 and C.I. Pigment Yellow 180.

As a process for producing a toner, in which the particle size distribution of the toner is sharpened, and the particle diameter is decreased and is uniform, with good shape controllability, an emulsion aggregation process is exemplified (details of which will be described later). In the emulsion aggregation process, a colorant dispersion having particles of a colorant dispersed in an aqueous solvent must be previously prepared, but the average particle diameter of the colorant particles in the colorant dispersion is difficult to be controlled. In order to control the average particle diameter of the colorant particles in the colorant dispersion, such a colorant dispersion is necessary that the colorant particles are dispersed into desired particle diameter in the aqueous medium (solvent) without aggregation, sedimentation or precipitation, and even when aggregated particles are formed with resin particles, the colorant particles are not aggregated with each other, and thus the selection of the colorant is important.

When the average particle diameter of the colorant particles in the colorant dispersion is large, it causes a problem in that the colorant particles are aggregated each other based on coarse particles as nuclei formed by sedimentation or precipitation of the colorant particles, whereby the OHP transparency is deteriorated due to deterioration in light transmittance of the colorant particles, and other various problems, such as isolation of the colorant upon forming aggregated particles with resin particles, and deterioration in charging property due to exposure of the colorant on the surface of the toner.

In some kinds of yellow pigments, when the average particle diameter of the colorant particles in the colorant dispersion is small, it causes a problem in that the resulting toner has insufficient coloring property, and therefore, the selection of the pigment as the colorant is important to obtain a toner having good transparency and high coloring power.

Furthermore, in the case where a toner of a small diameter of about 3 $\mu$m or less is produced to ensure high image quality, it is necessary to increase the content of the colorant in the toner to obtain the necessary coloring power, but the deterioration in production stability and aggregation to increase the particle diameter of the colorant particles in the toner are liable to occur, and therefore the selection of the pigment as the colorant becomes more important.

Under the circumstances, in the invention, it is preferred that the colorant particles contain a colorant having a structure shown by the following structural formula (1):

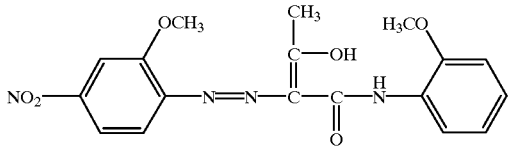

The colorant having the structure shown by the structural formula (1) is C.I. Pigment Yellow 74 as represented by the color index.

The colorant having the structure shown by the structural formula (1) often inherently has a small crystalline diameter (it is of course preferred to use a pigment having crystalline diameter as small as possible). Therefore, when the colorant having the structure shown by the structural formula (1) is used in the colorant particles of the invention, it can be dispersed to an average particle diameter of 100 nm or less with a small content of coarse particles (400 nm or more) inside the toner, and therefore the conditions of the dispersion state of the colorant particles specified in the invention can be satisfied. Accordingly, a toner causing less interception of transmitted light with high transparency can be obtained.

In general, a toner containing colorant particles having a small particle diameter is liable to have lowered coloring power, but because the colorant having the structure shown by the structural formula (1) has great coloring power, a toner for developing an electrostatic image of the invention using the same has good transparency and sufficient coloring power at the same time.

While toners using the colorant having the structure shown by the structural formula (1) have conventionally existed, because they have a dispersion average particle diameter inside the toner that is far larger than the invention and contains a large amount of coarse particles, they cannot achieve such extremely high toner performance that is obtained in the invention. In the invention, a toner that is extremely excellent in transparency and coloring power can be obtained by satisfying the conditions of the dispersion state of the colorant particles.

(c) Resin Component

The resin component in the toner for developing an electrostatic image of the invention is a polymer as a so-called thermoplastic binder resin, and specific examples thereof include a polymer of a monomer including a styrene compound, such as styrene, p-chlorostyrene and α-methylstyrene; an ester compound having a vinyl group, such as methyl acrylate, ethyl acrylate, n-propyl acrylate, lauryl acrylate, 2-ethylhexyl acrylate, methyl methacrylate, ethyl methacrylate, n-propyl methacrylate, lauryl methacrylate and 2-ethylhexyl methacrylate; a vinylnitrile compound, such as acrylonitrile and methacrylonitrile; a vinyl ether compound, such as vinyl methyl ether and vinyl isobutyl ether; a vinyl ketone compound, such as vinyl methyl ketone, vinyl ethyl ketone and vinyl isopropenyl ketone; and an olefin compound, such as ethylene, propylene and butadiene, a copolymer obtained by combining two or more of them, and a mixture thereof (all of which are called as a generic name "a vinyl series resin"). Examples thereof also include an epoxy resin, a polyester resin, a polyurethane resin, a polyamide resin, a cellulose resin, a polyether resin, a non-vinyl condensation resin, a mixture of the vinyl series resins with them, and a graft polymer obtained by polymerization of the vinyl series monomer in the presence of them. These resins may be used singly or used in combination of two or more of them.

Among these resins, a vinyl series resin is particularly preferred.

(d) Other Components

Other components, in addition to the colorant particles and the resin components, may be internally added or externally added to the toner for developing an electrostatic image of the invention. The other components will be described later in the section of the process for producing the toner for developing an electrostatic image.

(e) Preferred Characteristics of Toner for Developing Electrostatic Image

The toner for developing an electrostatic image of the invention preferably has a toner shape factor SF1 by the image analysis thereof of from 110 to 140. When the shape factor SF1 exceeds 140, the fluidity of the toner is deteriorated, and it adversely affects the transfer property from the initial stage. The average value of the shape factor SF1 of the toner can be calculated, for example, by the following manner. An optical micrograph of the toner dispersed on slide glass is loaded into a Luzex image analyzer via a video camera, and shape factors SF1 of 100 or more toner particles are calculated, followed by obtaining the average value thereof. The shape factor SF1 of the toner is expressed by the following equation:

$$SF1=(ML^2\times\pi/4A)\times 100$$

wherein ML represents a maximum length of the toner, and A represents a projected area of the toner.

The volume average particle diameter of the toner for developing an electrostatic image of the invention is preferably in the range from 2 to 8 μm, and more preferably in the range from 3 to 7 μm. When the volume average particle diameter of the toner is less than 2 μm, the charging property is liable to be insufficient, and the developing property is deteriorated in some cases, and when it exceeds 7 μm, there are cases where the resolution of the image is lowered, both cases of which are not preferred.

The volume average particle diameter of the toner herein means a particle diameter where the accumulated volume becomes 50% from the side of small diameter, and can be measured by a measuring apparatus, such as Coulter Counter TA-II (produced by Nikkaki Co., Ltd.) and Multisizer II (produced by Nikkaki Co., Ltd.)

With respect to particle size distribution of the toner for developing an electrostatic image of the invention, the volume average particle size distribution GSDv is preferably 1.28 or less, and more preferably 1.25 or less. The toner having such a sharp particle size distribution can be obtained by the emulsion aggregation process described later. When the GSDv exceeds 1.28, it is not preferred since the sharpness and resolution of the image are lowered.

The average particle size distribution index GSDv of the toner herein means a square root of a ratio ($D_{84v}/D_{16v}$) of a particle diameter $D_{16v}$ where the accumulated volume becomes 16% from the side of small diameter to a particle diameter $D_{84v}$ where the accumulated volume becomes 84%, which is measured by the similar apparatus as those for the volume average particle diameter.

Process for Preparation of the Toner for Developing Electrostatic Image

The toner for developing an electrostatic image according to the invention described in the foregoing can be produced by the conventional dry production process or the wet production process that is receiving attention in recent years.

Examples of the dry production process include a so-called kneading and pulverization method, in which toner components including a resin component, a coloring agent and a releasing agent are kneaded by a V blender or a Henschel mixer and then pulverized, followed by classifying, to obtain toner particles having a desired average particle diameter. Examples of the wet production process include an emulsion aggregation process.

In order to realize an image of high fineness corresponding to the demand for high image quality in a color image formation in recent years, and in order to prepare a small dot diameter, there is a demand that the toner has a small diameter and a uniform diameter. When image formation is conducted by using a toner having a broad particle size distribution, the fine particle component of the toner due to the broad particle size distribution causes problems of contamination of a developing roll (developer holding member), a charging roll, a contact blade, a photoreceptor (electrostatic latent image holding member) and a carrier, and scattering of the toner, and therefore it is difficult to realize high image quality and high reliability at the same time. Furthermore, the toner having a broad particle size distribution also involves a problem in that the reliability in a system having a cleaning function and a toner recycling function is deteriorated.

In order to realize high image quality and high reliability at the same time, it is necessary that the particle size distribution of the toner is sharpened, and the particle diameter is made small and uniform. It is therefore advantageous to employ the emulsion aggregation process according to the wet process that is being conducted in recent years rather than the conventional kneading and pulverization process. In the case of the wet process, such as the emulsion aggregation process, it is possible that the particle size distribution of the toner is sharpened, and the particle diameter is made small and uniform, with the shape controlling property being good.

The process for preparation of the toner for developing an electrostatic image of the invention by the emulsion aggregation process may be conducted by aggregating resin particles in a resin particle dispersion containing at least the resin particles dispersed therein (aggregating step), and then heating the aggregated particles to fuse them (fusing step), or in alternative, by adhering fine particles to the aggregated particles in a fine particle dispersion containing at least the fine particles dispersed therein (adhering step), and then heating the adhered particles to fuse them (fusing step).

The process for preparation of the toner for developing an electrostatic image of the invention by the emulsion aggregation process may preferably contain a first step (aggregating step) where aggregated particles are formed in a dispersion containing at least resin particles dispersed therein to prepare an aggregated particle dispersion, a second step (adhering step) where a fine particle dispersion containing fine particles dispersed therein is added to and mixed with the aggregated particle dispersion to adhere the fine particles to the aggregated particles, so as to form adhered particles, and a third step (fusing step) where the adhered particles are heated to fuse them.

In the first step (aggregating step), at least the resin particles are dispersed in the dispersion, and additionally colorant particles, releasing agent particles and other particles may also be dispersed. In order to disperse the colorant particles or the releasing agent particles, a resin particle dispersion and a colorant dispersion or a releasing agent dispersion are previously prepared, and the resin particle dispersion is mixed with the colorant dispersion and/or the releasing agent dispersion, and an aggregating agent is then added thereto to form aggregated particles.

It is preferred that the second step (adhering step) is conducted two times or more. In the second step, it is preferred that a releasing agent dispersion containing a releasing agent dispersed therein is added to and mixed with the dispersion of the aggregated particles obtained in the first step to adhere the releasing agent fine particles to the aggregated particles, so as to form adhered particles, and then a resin particles dispersion having resin particles dispersed therein is added to and mixed with it to adhere the resin particles to the adhered particles, so as to form adhered particles.

In the second step (adhering step), it is also preferred that a colorant dispersion containing colorant particles dispersed therein is added to and mixed with the dispersion of the aggregated particles obtained in the first step to adhere the colorant particles to the aggregated particles, so as to form adhered particles, and then a resin particles dispersion having resin particles dispersed therein is added to and mixed with it to adhere the resin particles to the adhered particles, so as to form adhered particles.

Furthermore, in the second step (adhering step), it is also preferred that a resin particle dispersion containing resin particles dispersed therein is added to and mixed with the dispersion of the aggregated particles obtained in the first step to adhere the resin particles to the aggregated particles, so as to form adhered particles, and then an inorganic fine particles dispersion containing inorganic fine particles dispersed therein is added to and mixed with it to adhere the inorganic fine particles to the adhered particles, so as to form adhered particles.

In the second step (adhering step), a dispersion of fine particles, such as the releasing agent, the resin, the colorant and the inorganic fine particles, is added to and mixed with the dispersion of the aggregated particles prepared in the first step to adhere the fine particles to the aggregated particles, so as to form adhered particles. The fine particles are those newly added to the aggregated particles, and therefore sometimes called as "additional particles".

The method for addition and mixing of the dispersion of the fine particles in the second step (adhering step) is not particularly limited, and it may be conducted gradually and continuously or may be conducted stepwise by separating into plural steps. By adding and mixing the fine particles (additional particles), formation of minute particles is prevented to make sharp the particle size distribution of the resulting toner for developing an electrostatic image. When the addition and mixing is conducted stepwise by separating into plural steps, layers of the fine particles are formed stepwise on the surface of the aggregated particles to make structural change and compositional gradient from the interior toward the outside of the particles of the toner for developing an electrostatic image, whereby the surface hardness of the particles can be improved, and furthermore, the particle size distribution can be maintained upon fusing in the third step described later to suppress the change thereof. Furthermore, it makes possible to omit the addition of a surfactant or a stabilizer, such as a base or an acid, for improving the stability upon fusing or suppress the amount thereof to the minimum, and thus it is advantageous in reduction of the cost and improvement in quality.

Examples of the polymer as the thermoplastic binder resin used in the resin particles in the emulsion aggregation process and examples of the polymer as the thermoplastic binder resin used in the kneading and pulverization process include those described in the section of the resin component. In the case of the emulsion aggregation process, the vinyl series resin among these is advantageous from the standpoint that the resin particle dispersion can be easily prepared by emulsion polymerization or seed polymerization using an ionic surfactant.

The average particle diameter of the resin particles in the resin particle dispersion is preferably 1 $\mu$m or less, and more preferably 0.01 to 1 $\mu$m. When the average particle diameter of the resin particles exceeds 1 $\mu$m, the particle size distribution of the toner for developing an electrostatic image finally obtained is broadened, and free particles are generated, which bring about deterioration in performance and reliability. When the average particle diameter of the resin particles is in the range, the problems described above can be eliminated, and mal-distribution within the toner is suppressed to improve the dispersion state in the toner, so as to reduce fluctuation in performance and reliability. The average particle diameter of the resin particles can be measured, for example, by a microtrack.

In the case of the vinyl series monomer, the resin particle dispersion can be prepared by conducting emulsion polymerization or seed polymerization using an ionic surfactant. In the case of the other resins that are oleophilic and dissolved in a solvent having a relatively low solubility in water, the resin dissolved in the solvent is finely dispersed in water by a disperser, such as a homogenizer, along with an ionic surfactant or a polymeric electrolyte, and then the solvent is evaporated by heating or reducing the pressure, so as to prepare the resin particle dispersion.

In the case where the toner for developing an electrostatic image of the invention is produced by the emulsion aggregation process, the 50% particle diameter (volume basis) of the colorant particles is preferably 100 nm or less, and more preferably from 70 to 90 nm. When the 50% particle diameter (volume basis) exceeds 100 nm, the toner for developing an electrostatic image finally obtained cannot satisfy the condition (1) of the dispersion state of the colorant particles specified in the invention, and the transparency is deteriorated, and the particle size distribution is broadened to form free particles, which bring about deterioration in performance and reliability.

In the case where the toner for developing an electrostatic image of the invention is produced by the emulsion aggregation process, the 84% particle diameter (volume basis) of the colorant particles is preferably 200 nm or less, and more preferably 180 nm or less. When the particles larger than 200 nm are present in a large amount, the toner for developing an electrostatic image finally obtained cannot satisfy the condition (2) of the dispersion state of the colorant particles specified in the invention, and deterioration of the transparency of the toner is accelerated.

When both the 50% particle diameter (volume basis) of the colorant particles of the colorant dispersion and the 84% particle diameter (volume basis) of the colorant particles are in the ranges, the problems can be eliminated, and mal-distribution within the toner is suppressed to improve the dispersion state in the toner, so as to reduce fluctuation in performance and reliability. The 50% particle diameter (volume basis) of the colorant particles and the 84% particle diameter (volume basis) of the colorant particles can be measured, for example, by a microtrack. The addition amount of the colorant is preferably from 1 to 20% by weight based on the total weight of the toner particles.

In the toner for developing an electrostatic image of the invention, various charge controlling agents that are ordinary used, such as a quaternary ammonium salt compound, a nigrosin compound, a dye containing a complex of aluminum, iron or chromium, and a triphenylmethane compound, may be used, and materials that is difficult to be dissolved in water are preferably used from the standpoint of control of the ion strength affecting the stability upon aggregation and fusing and reduction of pollution due to waste water.

In the emulsion aggregation process, a releasing agent dispersion may be added on mixing the resin particle dispersion and the colorant dispersion. Examples of the releasing agent including those in the case of the kneading and pulverization process include a low molecular weight polyolefin, such as polyethylene, polypropylene and polybutene; a silicone compound exhibiting a softening point by heating; a fatty acid amide, such as oleic amide, eucic amide, recinoleic amide and stearic amide; vegetable wax, such as carnauba wax, rice wax, candelilla wax, wood wax and a jojoba oil; animal wax, such as bees wax; mineral or petroleum wax, such as montan wax, ozokerite, ceresin, paraffin wax, microcrystalline wax and Fischer-Tropsch wax; and modification products thereof. The releasing agent may be used singly or used in combination of two or more of them.

The content of the releasing agent in the toner for developing an electrostatic image is preferably from 5 to 25% by weight based on the total weight of the toner, and more preferably from 7 to 20% by weight. When the content of the releasing agent is less than 5% by weight, the releasing property is insufficient to be liable to cause so-called offset where the toner sticks to the fixing roll upon high temperature fixing, and when it exceeds 30% by weight, the toner finally obtained becomes brittle, and the toner particles are liable to be broken by agitation in a developing device, both cases of which are not preferred.

The melting point of the releasing agent is preferably 30° C. or more, more preferably 40° C. or more, and particularly preferably 50° C. or more, from the standpoint of storage property of the toner.

The average particle diameter of the fine particles of the releasing agent in the emulsion aggregation process is preferably 1 $\mu$m or less, and more preferably 0.01 to 1 $\mu$m. When the average particle diameter of the fine particles of the releasing agent exceeds 1 $\mu$m, the particle size distribution of the toner for developing an electrostatic image finally obtained is broadened, and free particles are generated, which bring about deterioration in performance and reliability. When the average particle diameter of the releasing agent particles is in the range, the problems described above can be eliminated, and mal-distribution within the toner is suppressed to improve the dispersion state in the toner, so as to reduce fluctuation in performance and reliability. The average particle diameter of the fine particles of the releasing agent can be measured, for example, by a microtrack.

The releasing agent is dispersed in water along with an ionic surfactant and a polymeric electrolyte, such as a polymer acid and a polymer base, and is made into fine particles in a homogenizer or a pressure discharge disperser by heating to a temperature higher than the melting point and by applying a large shearing force, whereby it is added in the form of a dispersion of particles of 1 $\mu$m or less.

Examples of the surfactant used in the emulsion polymerization, the seed polymerization, the dispersion of the pigments, the dispersion of the resin particles, the dispersion of the releasing agent, the aggregation and the stabilization thereof include an anionic surfactant, such as a sulfate series, a sulfonate series, a phosphate series and a soap series; and a cationic surfactant, such as an amine salt series and a quaternary ammonium salt series, and it is also effective to combine them with a nonionic surfactant, such as a polyethylene glycol series, an alkylphenol ethyleneoxide adduct series and a polyvalent alcohol series. As the method for dispersing, those generally used can be employed, such as a rotation shearing type homogenizer, as well as a ball mill, a sand mill and a Dyno mill containing media.

In the third step (fusing step), heating is conducted by increasing to a temperature higher than the Tg of the resin particles, and the aggregated particles are fused by continuing agitation at that temperature.

The toner particles are separated from the toner liquid obtained by the emulsion aggregation process by centrifugation or suction filtration, and then washed with ion exchanged water once or plural times. Thereafter, the toner particles are filtered and dried to obtain the toner for developing an electrostatic image of the invention.

To the toner for developing an electrostatic image finally obtained by drying, inorganic particles, such as silica, alumina, titania and calcium carbonate, and organic fine particles, such as a vinyl series resin, polyester and silicone, may be externally added to the surface thereof in a dry state while applying a shear force, as other components (particles) such as a fluidizing aid, a cleaning aid, a lubricating agent and an abrasive agent.

Examples of the inorganic particles include all particles that are ordinary used as an external additive for the toner surface, such as silica, alumina, titania, calcium carbonate, magnesium carbonate, tricalcium phosphate and cerium oxide. Examples of the organic fine particles include all particles that are ordinary used as an external additive for the toner surface, such as a vinyl resin, a polyester resin and a silicone resin. The inorganic particles and the organic fine particles may be used, for example, as a fluidizing aid and a cleaning aid.

Examples of the lubricating agent include an aliphatic amide, such as ethylenebisstearic amide and oleic amide; and a fatty acid metallic salt, such as a zinc stearate and calcium stearate.

Examples of the abrasive agent include silica, alumina and cerium oxide described in the foregoing.

The average particle diameter of the other components (particles) is preferably 1 $\mu$m or less, and more preferably 0.01 to $\mu$m. When the average particle diameter exceeds 1 $\mu$m, the particle size distribution of the toner for developing an electrostatic image finally obtained is broadened, and free particles are generated, which bring about deterioration in performance and reliability. When the average particle diameter is in the range, the problems described above can be eliminated, and mal-distribution within the toner is suppressed to improve the dispersion state in the toner, so as to reduce fluctuation in performance and reliability. The average particle diameter can be measured, for example, by a microtrack.

In the emulsion aggregation process, examples of the dispersion medium in the resin particle dispersion, the colorant dispersion and the dispersions each having the other components (particles) dispersed therein include an aqueous medium.

Examples of the aqueous medium include water, such as distilled water and ion exchanged water, and an alcohol. These may be used singly or used in combination of two or more of them.

The content of the resin particles in the case where the resin particle dispersion and the colorant dispersion are mixed may be 40% by weight or less based on the total weight, and preferably about from 2 to 20% by weight. The content of the colorant may vary depending on the target particle diameter and coloring power, and it is generally 50% by weight or less based on the total weight, and preferably about 2 to 40% by weight. The content of the other components (particles) may be such an amount that does not inhibit the effect of the invention, and it is generally a slight amount, which is specifically about from 0.01 to 5% by weight based on the total weight, and preferably about from 0.5 to 2% by weight.

The method for preparing the resin particle dispersion is not particularly limited, and a method that is appropriately selected depending on the object may be employed. For example, it can be prepared in the following manner.

In the case where the resin of the resin particles is a homopolymer or a copolymer of the vinyl series monomer (vinyl series resin), such as the ester compound having a vinyl group, a vinyl nitrile compound, a vinyl ether compound and the vinyl ketone compound, a resin particles dispersion having the homopolymer or the copolymer of the vinyl series monomer (vinyl series resin) dispersed in an ionic surfactant can be prepared by conducting emulsion polymerization or seed polymerization of the vinyl series monomer in the ionic surfactant.

In the case where the resin of the resin particles is a resin other than the homopolymer or the copolymer of the vinyl series monomer, and the resin can be dissolved in a lipophilic solvent that has a relatively low solubility in water, the resin is dissolved in the lipophilic solvent, and the solution is added to water along with the ionic surfactant and the polymeric electrolyte, which are dispersed into fine particles by using a disperser such as a homogenizer, followed by evaporating the lipophilic solvent by heating or reducing the pressure, so as to prepare the resin particle dispersion.

The colorant dispersion in the emulsion aggregation process can be prepared, for example, by dispersing the colorant in an aqueous medium containing the surfactant.

The dispersion having the other components (particles) dispersed therein can be prepared, in the case where the other components (particles) are a releasing agent, for example, by dispersing in water along with the ionic surfactant and a polymeric electrolyte, such as a polymer acid and a polymer base. The dispersed releasing agent is then made into fine particles by applying a large shearing force by using a homogenizer or a pressure discharge type disperser under heating to a temperature higher than the melting point of the releasing agent, so as to prepare the dispersion. In the case where the other components (particles) are inorganic particles or the like, the inorganic particles or the like are dispersed in an aqueous medium containing the surfactant to prepare the dispersion.

In the case where the resin particles dispersed in the resin particle dispersion are composite particles containing other components than the resin particles, the dispersion having the composite particles dispersed therein can be prepared, for example, by the following manner. After dissolving or dispersing the components of the composite particles in a solvent, they are dispersed in water along with a suitable dispersant in the manner described in the foregoing, and the solvent is removed by heating or reducing the pressure, or in alternative, mechanical shearing or electric adsorption is applied to the surface of latex produced by emulsion polymerization or seed polymerization to fix the components, so as to prepare the dispersion.

The measure of dispersing is not particularly limited, and examples thereof include a known dispersing apparatus, such as a rotation shearing type homogenizer, as well as a ball mill, a sand mill and a Dyno mill containing media.

In the invention, it is preferred to add and mix a surfactant in the aqueous medium. Preferred examples of the surfactant that can be used include an anionic surfactant, such as a sulfate series, a sulfonate series, a phosphate series and a soap series; a cationic surfactant, such as an amine salt series and a quaternary ammonium salt series; and a nonionic surfactant, such as a polyethylene glycol series, an alkylphenol ethyleneoxide adduct series and a polyvalent alcohol series. Among these, an ionic surfactant is preferred, and an anionic surfactant and a cationic surfactant are more preferred.

The nonionic surfactant is preferably used in combination with the anionic surfactant or the cationic surfactant. The surfactants may be used singly or used in combination of two or more of them.

Specific examples of the anionic surfactant include a fatty acid soap, such as potassium laurate, sodium oleate and a sodium salt of castor oil; a sulfate, such as octyl sulfate, lauryl sulfate, laurylether sulfate and nonylphenyl sulfate; a sodium alkylnaphthalenesulfonate and a naphthalene sulfonate formalin adduct, such as lauryl sulfonate, dodecyl sulfonate, dodecylbenzene sulfonate, triisopropylnaphthalene sulfonate and dibutylnaphthalene sulfonate; a sulfonate, such as monooctyl sulfosuccinate, dioctyl sulfosuccinate, lauric amide sulfonate and oleic amide sulfonate; a phosphate, such as lauryl phosphate, isopropyl phosphate and nonylphenyl ether phosphate; and a sulfosuccinate, such as a sodium dialkylsulfosuccinate, e.g., sodium dioctylsulfosuccinate, disodium lauryl sulfosuccinate and disodium lauryl polyoxyethylene sulfosuccinate.

Specific examples of the cationic surfactant include an amine salt, such as laurylamine hydrochloride, stearylamine hydrochloride, oleylamine acetate, stearylamine acetate and stearylaminopropylamine acetate; and a quaternary ammonium salt, such as lauryltrimethyl ammonium chloride, dilauryldimethyl ammonium chloride, distearyl ammonium chloride, distearyldimethyl ammonium chloride, lauryldihydroxyethylmethyl ammonium chloride, oleylbispolyoxyethylenemethyl ammonium chloride, lauroylaminopropyldimethylethyl ammonium ethosulfate, lauroylamonpropyldimethylhydroxyethyl ammonium perchlorate, alkylbenzenedimethyl ammonium chloride and alkyltrimethyl ammonium chloride.

Specific examples of the nonionic surfactant include an alkyl ether, such as polyoxyethylene octyl ether, polyoxyethyelene lauryl ether, polyoxyethylene stearyl ether and polyoxyethylene oleyl ether; an alkyl phenyl ether, such as polyoxyethylene octyl phenyl ether and polyoxyethylene nonyl phenyl ether; an alkyl ester, such as polyoxyethylene laurate, polyoxyethylene stearate and polyoxyethylene oleate; an alkylamine, such as polyoxyethylene laurylamino ether, polyoxyethylene stearylamino ether, polyoxyethyelene oleylamino ether, polyoxyethylene soy bean amino ether and polyoxyethylene beef tallow amino ether; an alkylamide, such as polyoxyethylene lauric amide, polyoxyethyelene stearic amide and polyoxyethylene oleic amide; a vegetable oil ether, such as polyoxyethylene castor oil ether and polyoxyethylene colza oil ether; an alkanol amide, such as lauric diethanol amide, stearic diethanol amide and oleic diethanol amide; and a sorbitan ester ether, such as polyoxyethylene sorbitan monolaurate, polyoxyethylene sorbitan monopalmitate, polyoxyethylene sorbitan monostearate and polyoxyethylene sorbitan monooleate.

In the invention, it is preferred to use, as an aggregating agent, an inorganic metallic salt compound and an inorganic metallic salt polymer in addition to the ionic surfactant. The charging property and the environmental dependency can be improved, and the aggregation property can be increased by decreasing the amount of the surfactant remaining in the toner, and thus the incorporation rate of the colorant particles and the releasing agent particles can be increased, so as to contribute to the provision of sufficient coloring property and fixing property.

In the case where the second step (adhering step) is conducted, the toner for developing an electrostatic image obtained by the process for producing a toner for developing an electrostatic image has such a structure that the aggregated particles as mother particles having formed on the surface thereof a coating layer of the fine particles (additional particles). The number of the layer of the fine particles (additional particles) may be one or two or more, and the number of the layers agrees with the number of times of the second step (adhering step) conducted.

The toner for developing an electrostatic image obtained by the emulsion aggregation process is excellent in various characteristics, such as charging property, developing property, transferring property, fixing property and cleaning property, and particularly in light transmissibility of an image and coloring property. Furthermore, because it exhibits and maintains stably the characteristics without influence by environmental conditions, it has high reliability.

The toner for developing an electrostatic image of the invention has a smaller average particle diameter and a sharper particle size distribution in the case where it is produced by the emulsion aggregation process than that produced by the kneading and pulverization process.

Developer for Electrostatic Image

The developer for an electrostatic image of the invention is not particularly limited except that it contains the toner for developing an electrostatic image of the invention, and can have an appropriate composition depending on the objective use.

The developer for an electrostatic image of the invention is produced as a one-component developer for an electrostatic image when the toner for developing an electrostatic image of the invention is used singly, and is produced as a two-component developer for an electrostatic image when it is used in combination with a carrier.

The carrier used in the two-component developer is not particularly limited, and a known carrier, such as resin coated carriers described in JP-A-62-39879 and JP-A-56-11462, can be used.

The mixing ratio of the toner for developing an electrostatic image of the invention and the carrier in the developer for an electrostatic image is not particularly limited and can be appropriately selected depending on the objective use.

Process for Forming Image

The process for forming an image of the invention contains at least a latent image forming step of forming a latent image on a surface of an electrostatic latent image holding member, a developing step of developing the electrostatic latent image on the surface of the electrostatic latent image holding member by using a layer of a developer for an electrostatic image formed on a surface of a developer holding member to form a toner image, and a transferring step of transferring the toner image on the surface of the electrostatic latent image holding member to a surface of a transfer material, in which the developer for an electrostatic image contains the toner for developing an electrostatic image according to the invention. It may further contain a fixing step of fixing the toner image transferred to the surface of the transfer material by heat and/or pressure, and a cleaning step of removing the developer for an electrostatic image remaining on the surface of the electrostatic latent image holding member after transferring.

The steps themselves are ordinary steps and described, for example, in JP-A-56-40868 and JP-A-49-91231. The process for forming an image of the invention can be practiced by using an image forming apparatus, such as a duplicating machine and a facsimile machine.

In the process for producing an image of the invention, an embodiment further containing a recycling step is preferred. The recycling step is a step of transferring the toner for developing an electrostatic image recovering in the cleaning step to the layer of the developer for an electrostatic image. The embodiment of the process for forming an image containing the recycling step can be practiced by using an image forming apparatus of a toner recycling type, such as a duplicating machine and a facsimile machine. It can be also applied to a recycling system having such an embodiment that the cleaning step is omitted, and the toner is recovered simultaneously with development.

The invention will be described in more detail with reference to the following examples, but the invention is not construed as being limited to the examples.

A: PREPARATION OF RESIN PARTICLE DISPERSION

| Preparation of Resin Particle Dispersion (1) | |
|---|---|
| Styrene | 270 g |
| n-Butyl acrylate | 30 g |
| Acrylic acid | 5 g |
| Dodecane thiol | 22 g |
| Carbon tetrabromide | 3 g |

A solution obtained by mixing and dissolving the components described above is dispersed and emulsified in a solution obtained by dissolving 7 g of an nonionic surfactant (Nonipole 400 produced by Sanyo Chemical Industries, Ltd.) and 11 g of an anionic surfactant (Neogen SC produced by Dai-ich Kogyo Seiyaku Co., Ltd.) in 500 g of ion exchanged water in a flask, and 50 g of a solution obtained by dissolving 3 g of ammonium persulfate (produced by Wako Pure Chemical Co., Ltd.) in ion exchanged water is put thereinto over 10 minutes while slowly mixing. After substituted with nitrogen, the content of the flask is heated to 70° C. under stirring by an oil bath, and emulsion polymerization is continued for 5 hours. Thereafter, the reaction liquid is cooled to room temperature, so as to prepare a resin particle dispersion (1) containing a resin having a glass transition point of 60° C. and a weight average molecular weight of 14,000 dispersed therein.

| Preparation of Resin Particle Dispersion (2) | |
|---|---|
| Stryene | 380 g |
| n-Butyl acrylate | 190 g |
| Acrylic acid | 12 g |

A solution obtained by mixing and dissolving the components described above is dispersed and emulsified in a solution obtained by dissolving 10 g of an nonionic surfactant (Nonipole 400 produced by Sanyo Chemical Industries, Ltd.) and 15 g of an anionic surfactant (Neogen SC produced by Dai-ich Kogyo Seiyaku Co., Ltd.) in 600 g of ion exchanged water in a flask, and 60 g of a solution obtained by dissolving 5 g of ammonium persulfate (produced by Wako Pure Chemical Co., Ltd.) in ion exchanged water is put thereinto over 10 minutes while slowly mixing. After substituted with nitrogen, the content of the flask is heated to 70° C. under stirring by an oil bath, and emulsion polymerization is continued for 5 hours. Thereafter, the reaction liquid is cooled to room temperature, so as to prepare a resin particle dispersion (2) containing a resin having a glass transition point of 57° C. and a weight average molecular weight of 4,500,000 dispersed therein.

B: PREPARATION OF COLORANT DISPERSION

| Preparation of Colorant Dispersion (1) | |
|---|---|
| C.I. Pigment Yellow 74 (colorant having the structural formula (1) produced by Clariant Japan Co., Ltd.) | 50 g |
| Anionic surfactant (Neogen SC produced by Dai-ich Kogyo Seiyaku Co., Ltd.) | 10 g |
| Ion exchanged water | 240 g |

The component described above are mixed and dispersed for 10 minutes by using a homogenizer (Ultra-Turrax 750 produced by IKA Works Inc.) and then subjected to a pressure discharge type homogenizer to prepare a colorant dispersion (1). In the colorant dispersion (1), the colorant particles had a 50% particle diameter (volume basis) of 93 nm and an 84% particle diameter (volume basis) of 179 nm.

| Preparation of Colorant Dispersion (2) | |
|---|---|
| C.I. Pigment Yellow 180 (produced by Clariant Japan Co., Ltd.) | 50 g |
| Anionic surfactant (Neogen SC produced by Dai-ich Kogyo Seiyaku Co., Ltd.) | 10 g |
| Ion exchanged water | 240 g |

The components described above are mixed, and a colorant dispersion (2) is prepared in the same conditions as in the preparation of the colorant dispersion (1). In the colorant dispersion (2), the colorant particles had a 50% particle diameter (volume basis) of 200 nm and an 84% particle diameter (volume basis) of 385 nm.

| Preparation of Colorant Dispersion (3) | |
|---|---|
| C.I. Pigment Yellow 74 (colorant having the structural formula (1) produced by Clariant Japan Co., Ltd.) | 50 g |
| Anionic surfactant (Neogen SC produced by Dai-ich Kogyo Seiyaku Co., Ltd.) | 10 g |
| Ion exchanged water | 240 g |

The component described above are mixed and dispersed, under different conditions from those in the preparation of the colorant dispersion (1), for 10 minutes by using a homogenizer (Ultra-Turrax 750 produced by IKA Works Inc.) and then subjected to a pressure discharge type homogenizer to prepare a colorant dispersion (3). In the colorant dispersion (3), the colorant particles had a 50% particle diameter (volume basis) of 220 nm and an 84% particle diameter (volume basis) of 330 nm.

C: PREPARATION OF RELEASING AGENT DISPERSION

| Preparation of Releasing Agent Disperion (1) | |
|---|---|
| Paraffin wax (HNP0190 produced by Nippon Seiro Co., Ltd.) | 60 g |

-continued

| Preparation of Releasing Agent Disperion (1) | |
|---|---|
| Anionic surfactant (Neogen SC produced by Dai-ich Kogyo Seiyaku Co., Ltd.) | 10 g |
| Ion exchanged water | 300 g |

The components described above are mixed and dispersed for 10 minutes by using a homogenizer (Ultra-Turrax 750 produced by IKA Works Inc.) and then subjected to a pressure discharge type homogenizer to prepare a releasing agent dispersion having a mean particle diameter of 160 nm.

EXAMPLE 1

Aggregation Step

| | |
|---|---|
| Resin particle dispersion (1) | 140 g |
| Colorant dispersion (1) | 40 g |
| Releasing agent dispersion (1) | 40 g |
| Cationic surfactant (Sanisol B50 produced by Kao Corp.) | 1.5 g |

The components described above are mixed and dispersed in a round stainless steel flask by using Ultra-Turrax T50 (produced by IKA Works Inc.), and then heated under stirring to 57° C. by an oil bath for heating. After maintaining at 57° C. for 1 hour, the particle size is measured by a Coulter counter (Multisizer 2 produced by Coulter Inc.), and it is thus confirmed that aggregated particles of 4.9 μm are formed.

The temperature of the oil bath for heating is further increased to 58° C. and maintained for 1 hour. The particle size is measured in the same manner, and thus it is thus confirmed that aggregated particles of 5.3 μm are formed.

Adhering Step 60 g of the resin particle dispersion (1) is gradually added to the dispersion containing the aggregated particles, and the temperature of the oil bath for heating is further increased to 59° C. and maintained for 1 hour. The particle size of the resulting adhered particles is measured in the same manner, and thus it is 5.5 μm.

Fusing Step

After adding 3 g of an anionic surfactant (Neogen SC produced by Dai-ich Kogyo Seiyaku Co., Ltd.) to the dispersion containing the adhered particles, the stainless steel flask is sealed and heated to 95° C. under continued stirring using a magnetic seal, which is maintained for 4 hours. After cooling, the content is filtered and then washed with ion exchanged water 5 times, followed by drying in a vacuum dryer, so as to obtain toner particles (yellow toner J-1 for developing an electrostatic image). A sample of the supernatant liquid is substantially colorless and transparent, and isolation of the colorant and the releasing agent is not observed.

Evaluation of Characteristics of Yellow Toner for Developing Electrostatic Image The volume average particle diameter of the toner particles of the thus resulting yellow toner J-1 for developing an electrostatic image is measured by a Coulter counter (Multisizer 2 produced by Coulter Inc.), and thus it is 5.5 μm. The volume average particle size distribution GSDv as an index of the range of particle size distribution is measured, and thus it is as good as 1.20. When a shape factor SF1 is calculated from an image obtained by observing a small amount of the toner sampled on slide glass with an optical microscope using a Luzex image analyzer, it is 130 and the appearance is of a potato shape.

As a result of observation of the cross section of the yellow toner J-1 for developing an electrostatic image by a transmission electron microscope (TEM), the dispersion average particle diameter of the colorant particles inside the toner particles is 94 nm, and thus it is confirmed that they are dispersed in good conditions. The proportion of coarse particles of 400 nm or more in the entire of colorant particles in the toner particles is calculated by the image analyzer, and thus it is 1.6% by number.

Preparation of Developer for Electrostatic Image 1 g of hydrophobic silica (TS720 produced by Cabot Inc.) is added to 50 g of the yellow toner J-1 for developing an electrostatic image and blended in a sample mill. The resulting blend is weighed in such a manner that the toner concentration with respect to a ferrite carrier having a volume average particle diameter of 50 μm coated with 1% by weight of polymethyl methacrylate (produced by Soken Chemical Co., Ltd.) is 5% by weight, which are stirred and mixed for 5 minutes in a ball mill, so as to prepare a developer J-1 for an electrostatic image.

Evaluation of Developer for Electrostatic Image

By using the resulting developer J-1 for an electrostatic image, oilless fixing is conducted in an image forming apparatus (a modified machine of A-COLOR 630 produced by Fuji Xerox Co., Ltd., in which an oilless fixing device had been installed). The image density in the case where the weight of an unfixed image per unit area is 0.4 mg/cm$^2$ is measured by X-Rite (404 produced by X-Rite, Incorporated), and thus it is as good as 1.54 under normal temperature and normal humidity conditions (23° C., 60% RH).

When the image density is measured in the same manner where the weight of an unfixed image per unit area is 0.2 mg/cm$^2$, it is 1.36 under high temperature and high humidity conditions (28° C., 85% RH) and 1.34 under low temperature and low humidity conditions (10° C., 30% RH), which are of the level causing no problem.

The transparency of a fixed image on an OHP transparent film thus obtained is evaluated by a visual examination, and thus it is good.

EXAMPLE 2

Aggregation Step

| | |
|---|---|
| Resin particle dispersion (2) | 200 g |
| Colorant dispersion (1) | 40 g |
| Releasing agent dispersion (1) | 40 g |
| Zinc chloride | 1.5 g |

The components described above are mixed and dispersed in a round stainless steel flask by using Ultra-Turrax T50 (produced by IKA Works Inc.), and then heated under stirring to 56° C. by an oil bath for heating. After maintaining at 56° C. for 1 hour, the particle size is measured by a Coulter counter (Multisizer 2 produced by Coulter Inc.), and it is thus confirmed that aggregated particles of 4.7 μm are formed.

The temperature of the oil bath for heating is further increased to 58° C. and maintained for 1 hour. The particle size is measured in the same manner, and thus it is thus confirmed that aggregated particles of 5.1 μm are formed.

Adhering Step 60 g of the resin particle dispersion (2) is gradually added to the dispersion containing the aggregated particles, and the temperature of the oil bath for heating is further increased to 59° C. and maintained for 1 hour. The particle size of the resulting adhered particles is measured in the same manner, and thus it is 5.6 μm.

Fusing Step

After adding 3 g of an anionic surfactant (Neogen SC produced by Dai-ich Kogyo Seiyaku Co., Ltd.) to the dispersion containing the adhered particles, the pH of the dispersion containing the adhered particles at 59° C. is measured and is 2.7. After adjusting the pH at 59° C. to 6 by adding a 1 mol/L aqueous solution of NaOH, the stainless steel flask is sealed and heated to 97° C. under continued stirring using a magnetic seal, which is maintained for 6 hours. After cooling, the content is filtered and then washed with ion exchanged water 5 times, followed by drying in a vacuum dryer, so as to obtain toner particles (yellow toner J-2 for developing an electrostatic image). A sample of the supernatant liquid is substantially colorless and transparent, and isolation of the colorant and the releasing agent is not observed.

Evaluation of Characteristics of Yellow Toner for Developing Electrostatic Image The volume average particle diameter of the toner particles of the thus resulting yellow toner J-2 for developing an electrostatic image is measured by a Coulter counter (Multisizer 2 produced by Coulter Inc.), and thus it is 5.6 μm. The volume average particle size distribution GSDv as an index of the range of particle size distribution is measured, and thus it is as good as 1.20. When a shape factor SF1 is calculated from an image obtained by observing a small amount of the toner sampled on slide glass with an optical microscope using a Luzex image analyzer, it is 120 and the appearance is of a spherical shape.

As a result of observation of the cross section of the yellow toner J-2 for developing an electrostatic image by a transmission electron microscope (TEM), the dispersion average particle diameter of the colorant particles inside the toner particles is 73 nm, and thus it is confirmed that they are dispersed in good conditions. The proportion of coarse particles of 400 nm or more in the entire of colorant particles in the toner particles is calculated by the image analyzer, and thus it is 0.6% by number.

Preparation of Developer for Electrostatic Image 1 g of hydrophobic silica (TS720 produced by Cabot Inc.) is added to 50 g of the yellow toner J-2 for developing an electrostatic image and blended in a sample mill. The resulting blend is weighed in such a manner that the toner concentration with respect to a ferrite carrier having a volume average particle diameter of 50 μm coated with 1% by weight of polymethyl methacrylate (produced by Soken Chemical Co., Ltd.) is 5% by weight, which are stirred and mixed for 5 minutes in a ball mill, so as to prepare a developer J-2 for an electrostatic image.

Evaluation of Developer for Electrostatic Image Evaluation is conducted by using the resulting developer J-2 for an electrostatic image in the same manner as in Example 1. The image density in the case where the weight of an unfixed image per unit area is 0.4 mg/cm$^2$ is as good as 1.53 under normal temperature and normal humidity conditions (23° C., 60% RH).

When the image density is measured in the same manner where the weight of an unfixed image per unit area is 0.2 mg/cm$^2$, it is 1.35 under high temperature and high humidity conditions (28° C., 85% RH) and 1.33 under low temperature and low humidity conditions (10° C., 30% RH), which are of the level causing no problem.

The transparency of a fixed image on an OHP transparent film thus obtained is evaluated by a visual examination, and thus it is good.

COMPARATIVE EXAMPLE 1

Aggregation Step

| | |
|---|---|
| Resin particle dispersion (1) | 140 g |
| Colorant dispersion (2) | 40 g |
| Releasing agent dispersion (1) | 40 g |
| Cationic surfactant | 1.5 g |

(Sanisol B50 produced by Kao Corp.)

The components described above are mixed and dispersed in a round stainless steel flask by using Ultra-Turrax T50 (produced by IKA Works Inc.), and then heated under stirring to 57° C. by an oil bath for heating. After maintaining at 57° C. for 1 hour, the particle size is measured by a Coulter counter (Multisizer 2 produced by Coulter Inc.), and it is thus confirmed that aggregated particles of 4.9 μm are formed.

The temperature of the oil bath for heating is further increased to 58° C. and maintained for 1 hour. The particle size is measured in the same manner, and thus it is thus confirmed that aggregated particles of 5.3 μm are formed.

Adhering Step 60 g of the resin particle dispersion (1) is gradually added to the dispersion containing the aggregated particles, and the temperature of the oil bath for heating is further increased to 59° C. and maintained for 1 hour. The particle size of the resulting adhered particles is measured in the same manner, and thus it is 5.5 μm.

Fusing Step

After adding 3 g of an anionic surfactant (Neogen SC produced by Dai-ich Kogyo Seiyaku Co., Ltd.) to the dispersion containing the adhered particles, the stainless steel flask is sealed and heated to 95° C. under continued stirring using a magnetic seal, which is maintained for 4 hours. After cooling, the content is filtered and then washed with ion exchanged water 5 times, followed by drying in a vacuum dryer, so as to obtain toner particles (comparative yellow toner h-1). A sample of the supernatant liquid is slightly turbid, and isolation of the colorant and the releasing agent is observed.

Evaluation of Characteristics of Yellow Toner for Developing Electrostatic Image The volume average particle diameter of the toner particles of the thus resulting comparative yellow toner h-1 is measured by a Coulter counter (Multisizer 2 produced by Coulter Inc.), and thus it is 5.5 μm. The volume average particle size distribution GSDv as an index of the range of particle size distribution is measured, and thus it is 1.21. When a shape factor SF1 is calculated from an image obtained by observing a small amount of the toner sampled on slide glass with an optical microscope using a Luzex image analyzer, it is 130 and the appearance is of a potato shape.

As a result of observation of the cross section of the comparative yellow toner h-1 by a transmission electron microscope (TEM), it is confirmed that the dispersion average particle diameter of the colorant particles inside the toner particles is 300 nm. The proportion of coarse particles of 400 nm or more in the entire of colorant particles in the toner particles is calculated by the image analyzer, and thus it is 9.0% by number.

Preparation of Developer for Electrostatic Image 1 g of hydrophobic silica (TS720 produced by Cabot Inc.) is added to 50 g of the comparative yellow toner h-1 and blended in a sample mill. The resulting blend is weighed in such a manner that the toner concentration with respect to a ferrite carrier having a volume average particle diameter of 50 μm coated with 1% by weight of polymethyl methacrylate (produced by Soken Chemical Co., Ltd.) is 5% by weight, which are stirred and mixed for 5 minutes in a ball mill, so as to prepare a developer h-1 for an electrostatic image.

Evaluation of Developer for Electrostatic Image

Evaluation is conducted by using the resulting developer h-1 for an electrostatic image in the same manner as in Example 1. Somewhat background contamination (fogging) and scattering are found in the resulting image. The image density in the case where the weight of an unfixed image per unit area is 0.4 mg/cm$^2$ is as good as 1.31 under normal temperature and normal humidity conditions (23° C., 60% RH), which is somewhat poor in coloring property although there is no problem upon practical use.

The image density measured in the same manner where the weight of an unfixed image per unit area is 0.2 mg/cm$^2$ is 1.05 under high temperature and high humidity conditions (28° C., 85% RH) and 1.02 under low temperature and low humidity conditions (10° C., 30% RH), which caused an image of poor coloring property.

The transparency of a fixed image on an OHP transparent film thus obtained is evaluated by a visual examination, and thus it contains somewhat turbidity.

COMPARATIVE EXAMPLE 2

Aggregation Step

| | |
|---|---|
| Resin particle dispersion (2) | 140 g |
| Colorant dispersion (2) | 40 g |
| Releasing agent dispersion (1) | 40 g |
| Zinc chloride | 1.5 g |

The components described above are mixed and dispersed in a round stainless steel flask by using Ultra-Turrax T50 (produced by IKA Works Inc.), and then heated under stirring to 56° C. by an oil bath for heating. After maintaining at 56° C. for 1 hour, the particle size is measured by a Coulter counter (Multisizer 2 produced by Coulter Inc.), and it is thus confirmed that aggregated particles of 4.7 μm are formed.

The temperature of the oil bath for heating is further increased to 58° C. and maintained for 1 hour. The particle size is measured in the same manner, and thus it is thus confirmed that aggregated particles of 5.1 μm are formed.

Adhering Step 60 g of the resin particle dispersion (2) is gradually added to the dispersion containing the aggregated particles, and the temperature of the oil bath for heating is further increased to 59° C. and maintained for 2 hour. The particle size of the resulting adhered particles is measured in the same manner, and thus it is 5.6 μm.

Fusing Step

After adding 3 g of an anionic surfactant (Neogen SC produced by Dai-ich Kogyo Seiyaku Co., Ltd.) to the dispersion containing the adhered particles, the pH of the dispersion containing the adhered particles at 59° C. is measured and is 2.5. After adjusting the pH at 59° C. to 6 by adding a 1 mol/L aqueous solution of NaOH, the stainless steel flask is sealed and heated to 97° C. under continued stirring using a magnetic seal, which is maintained for 6 hours. After cooling, the content is filtered and then washed with ion exchanged water 5 times, followed by drying in a vacuum dryer, so as to obtain toner particles (comparative yellow toner h-2). A sample of the supernatant liquid is slightly turbid, and isolation of the colorant is observed.

Evaluation of Characteristics of Yellow Toner for Developing Electrostatic Image The volume average particle diameter of the toner particles of the thus resulting comparative yellow toner h-2 is measured by a Coulter counter (Multisizer 2 produced by Coulter Inc.), and thus it is 5.6 μm. The volume average particle size distribution GSDv as an index of the range of particle size distribution is measured, and thus it is 1.25. When a shape factor SF1 is calculated from an image obtained by observing a small amount of the toner sampled on slide glass with an optical microscope using a Luzex image analyzer, it is 121 and the appearance is of a spherical shape.

As a result of observation of the cross section of the comparative yellow toner h-2 by a transmission electron microscope (TEM), it is confirmed that the dispersion average particle diameter of the colorant particles inside the toner particles is 350 nm. The proportion of coarse particles of 400 nm or more in the entire of colorant particles in the toner particles is calculated by the image analyzer, and thus it is 10.0% by number.

Preparation of Developer for Electrostatic Image 1 g of hydrophobic silica (TS720 produced by Cabot Inc.) is added to 50 g of the comparative yellow toner h-2 and blended in a sample mill. The resulting blend is weighed in such a manner that the toner concentration with respect to a ferrite carrier having a volume average particle diameter of 50 μm coated with 1% by weight of polymethyl methacrylate (produced by Soken Chemical Co., Ltd.) is 5% by weight, which are stirred and mixed for 5 minutes in a ball mill, so as to prepare a developer h-2 for an electrostatic image.

Evaluation of Developer for Electrostatic Image

Evaluation is conducted by using the resulting developer h-2 for an electrostatic image in the same manner as in Example 1. Somewhat background contamination (fogging) and scattering are found in the resulting image. The image density in the case where the weight of an unfixed image per unit area is 0.4 mg/cm$^2$ is as good as 1.18 under normal temperature and normal humidity conditions (23° C., 60% RH), which is poor in coloring property.

The image density measured in the same manner where the weight of an unfixed image per unit area is 0.2 mg/cm$^2$ is 1.03 under high temperature and high humidity conditions (28° C., 60% RH) and 1.01 under low temperature and low humidity conditions (10° C., 30% RH), which caused an image of poor coloring property.

The transparency of a fixed image on an OHP transparent film thus obtained is evaluated by a visual examination, and thus it contains turbidity.

COMPARATIVE EXAMPLE 3

Aggregation Step

| | |
|---|---|
| Resin particle dispersion (2) | 140 g |
| Colorant dispersion (3) | 40 g |
| Releasing agent dispersion (1) | 40 g |
| Zinc chloride | 1.5 g |

The components described above are mixed and dispersed in a round stainless steel flask by using Ultra-Turrax T50 (produced by IKA Works Inc.), and then heated under stirring to 56° C. by an oil bath for heating. After maintaining at 56° C. for 1 hour, the particle size is measured by a Coulter counter (Multisizer 2 produced by Coulter Inc.), and it is thus confirmed that aggregated particles of 4.7 μm are formed.

The temperature of the oil bath for heating is further increased to 58° C. and maintained for 1 hour. The particle size is measured in the same manner, and thus it is thus confirmed that aggregated particles of 5.1 μm are formed.

Adhering Step 60 g of the resin particle dispersion (2) is gradually added to the dispersion containing the aggregated particles, and the temperature of the oil bath for heating is further increased to 59° C. and maintained for 2 hour. The particle size of the resulting adhered particles is measured in the same manner, and thus it is 5.6 μm.

Fusing Step

The pH of the dispersion containing the adhered particles at 59° C. is measured and is 2.5. After adjusting the pH at 59° C. to 6 by adding a 1 mol/L aqueous solution of NaOH, the stainless steel flask is sealed and heated to 97° C. under continued stirring using a magnetic seal, which is maintained for 6 hours. After cooling, the content is filtered and then washed with ion exchanged water 5 times, followed by drying in a vacuum dryer, so as to obtain toner particles (comparative yellow toner h-3). A sample of the supernatant liquid is slightly turbid, and isolation of the colorant is observed.

Evaluation of Characteristics of Yellow Toner for Developing Electrostatic Image The volume average particle diameter of the toner particles of the thus resulting comparative yellow toner h-3 is measured by a Coulter counter (Multisizer 2 produced by Coulter Inc.), and thus it is 5.6 μm. The volume average particle size distribution GSDv as an index of the range of particle size distribution is measured, and thus it is 1.25. When a shape factor SF1 is calculated from an image obtained by observing a small amount of the toner sampled on slide glass with an optical microscope using a Luzex image analyzer, it is 121 and the appearance is of a spherical shape.

As a result of observation of the cross section of the comparative yellow toner h-3 by a transmission electron microscope (TEM), it is confirmed that the dispersion average particle diameter of the colorant particles inside the toner particles is 290 nm. The proportion of coarse particles of 400 nm or more in the entire of colorant particles in the toner particles is calculated by the image analyzer, and thus it is 13.0% by number.

Preparation of Developer for Electrostatic Image 1 g of hydrophobic silica (TS720 produced by Cabot Inc.) is added to 50 g of the comparative yellow toner h-3 and blended in a sample mill. The resulting blend is weighed in such a manner that the toner concentration with respect to a ferrite carrier having a volume average particle diameter of 50 μm coated with 1% by weight of polymethyl methacrylate (produced by Soken Chemical Co., Ltd.) is 5% by weight, which are stirred and mixed for 5 minutes in a ball mill, so as to prepare a developer h-3 for an electrostatic image.

Evaluation of Developer for Electrostatic Image

Evaluation is conducted by using the resulting developer h-3 for an electrostatic image in the same manner as in Example 1. Somewhat background contamination (fogging) and scattering are found in the resulting image. The image density in the case where the weight of an unfixed image per unit area is 0.4 mg/cm$^2$ is as good as 1.16 under normal temperature and normal humidity conditions (23° C., 60% RH), which is poor in coloring property.

The image density measured in the same manner where the weight of an unfixed image per unit area is 0.2 mg/cm$^2$ is 1.04 under high temperature and high humidity conditions (28° C., 60% RH) and 1.02 under low temperature and low humidity conditions (10° C., 30% RH), which caused an image of poor coloring property.

The transparency of a fixed image on an OHP transparent film thus obtained is evaluated by a visual examination, and thus it contains turbidity.

As described in the foregoing, the invention provides a toner for developing an electrostatic image and a developer for an electrostatic image using the toner for developing an electrostatic image that are excellent in coloring property and particularly in light transmissibility and fixing property and satisfies high image quality and high reliability.

The invention also provides a process for producing a toner for developing an electrostatic image that can produce the toner for developing an electrostatic image excellent in various properties in a convenient and simple manner without isolation of a colorant and a releasing agent.

The invention also provides a process for forming an image that can form a full color image of high color saturation on paper and an OHP sheet in a convenient and simple manner.

What is claimed is:

1. A toner for developing an electrostatic image comprising a resin and colorant particles, wherein the colorant particles are yellow pigment particles, the colorant particles exhibiting a dipersion state inside toner observed by a transmission electron microscope, the state satisfying the following conditions:

(1) the colorant particles have a dispersion average particle diameter of 100 nm or less; and (2) a content of coarse colorant particles of a diameter of 400 nm or more is 5% by number or less of the total of the colorant particles.

2. A toner for developing an electrostatic image as claimed in claim 1, wherein the yellow pigment is selected from C.I. Pigment Yellow 74, C.I. Pigment Yellow 93, C.I. Pigment Yellow 94, C.I. Pigment Yellow 95, C.I. Pigment Yellow 12, C.I. Pigment Yellow 13, C.I. Pigment Yellow 14, C.I. Pigment Yellow 16, C.I. Pigment Yellow 17 and C.I. Pigment Yellow 180.

3. A toner for developing an electrostatic image as claimed in claim 2, wherein the yellow pigment is C.I. Pigment Yellow 74.

4. A toner for developing an electrostatic image as claimed in claim 1, wherein the toner for developing an electrostatic image has a shape factor SF1 in a range from 110 to 140.

5. A toner for developing an electrostatic image as claimed in claim 1, wherein the toner for developing an electrostatic image has a volume average particle size distribution GSDv of 1.28 or less.

6. A process for preparation of toner for developing an electrostatic image, the process comprising:

mixing at least one kind of resin particle dispersion, at least one kind of colorant dispersion, wherein the colorant is a yellow pigment, at least one kind of releasing agent dispersion, and an aggregating agent to form aggregated particles; and fusing the aggregating particles by heating to a temperature higher than a glass transition point of resin particles in the resin particles dispersion to form toner particles, wherein the toner particles exhibit a dispersion state of the colorant particles inside thereof observed by a transmission electron microscope, the state satisfying the following conditions:

(1) the colorant particles have a dispersion average particle diameter of 100 nm or less; and (2) a content of coarse colorant particles of a diameter of 400 nm or more 5% by number or less of the total of the colorant particles.

7. A process for preparation of a toner for developing an electrostatic image as claimed in claim 6, wherein the yellow pigment is selected from C.I. Pigment Yellow 74, C.I. Pigment Yellow 93, C.I. Pigment Yellow 94, C.I. Pigment Yellow 95, C.I. Pigment Yellow 12, C.I. Pigment Yellow 13, C.I. Pigment Yellow 14, C.I. Pigment Yellow 16, C.I. Pigment Yellow 17 and C.I. Pigment Yellow 180.

8. A process for preparation of a toner for developing an electrostatic image as claimed in claim 7, wherein the yellow pigment is C.I. Pigment Yellow 74.

9. A process for preparation of a toner for developing an electrostatic image as claimed in claim 6, wherein the toner has a shape factor SF1 in a range from 110 to 140.

10. A process for preparation of a toner for developing an electrostatic image as claimed in claim 6, wherein the toner for developing an electrostatic image has a volume average particle size distribution GSDv of 1.28 or less.

11. A process for preparation of a toner for developing an electrostatic image as claimed in claim 6, wherein the colorant dispersion has a 50% particle diameter (volume basis) of the colorant particles of 100 nm or less.

12. A process for preparation of a toner for developing an electrostatic image as claimed in claim 6, wherein colorant dispersion has a 84% particle diameter (volume basis) of the colorant particles of 200 nm or less.

13. A process for forming an image, comprising:

forming an electrostatic latent image on a surface of an electrostatic latent image holding member;

developing the electrostatic latent image on the surface of the electrostatic latent image holding member to form a toner image by using a layer of a developer for an electrostatic image containing the toner as claimed in claim 1, the layer of the developer being formed on a surface of a developer holding member; and transferring the toner image developed on the surface of the electrostatic latent image holding member to a surface of a transfer material. and C.I. Pigment Yellow 180.

14. A process for forming an image as claimed in claim 13, wherein the yellow pigment is selected from C.I. Pigment Yellow 74, C.I. Pigment Yellow 93, C.I. Pigment Yellow 94, C.I. Pigment Yellow 95, C.I. Pigment Yellow 12, C.I. Pigment Yellow 13, C.I. Pigment Yellow 14, C.I. Pigment Yellow 16, C.I. Pigment Yellow 17 and C.I. Pigment Yellow 180.

15. A process for forming an image as claimed in claim 13, wherein the toner has a shape factor SF1 in a range from 110 to 140.

16. A process for forming an image as claimed in claim 13, wherein the toner for developing an electrostatic image has a volume average particle size distribution GSDv of 1.28 or less.

* * * * *